US009499998B2

(12) United States Patent
Bardelli et al.

(10) Patent No.: US 9,499,998 B2
(45) Date of Patent: Nov. 22, 2016

(54) ANCHORING SYSTEM OF OBJECTS IN THE GROUND

(71) Applicant: Guido Bardelli, Carpi (IT)

(72) Inventors: Guido Bardelli, Carpi (IT); Giancarlo Picca, Bomporto (IT)

( * ) Notice: Subject to any disclaimer, the term of this patent is extended or adjusted under 35 U.S.C. 154(b) by 0 days.

(21) Appl. No.: 14/439,584

(22) PCT Filed: Oct. 30, 2013

(86) PCT No.: PCT/IT2013/000300

§ 371 (c)(1),
(2) Date: Apr. 29, 2015

(87) PCT Pub. No.: WO2014/068604

PCT Pub. Date: May 8, 2014

(65) Prior Publication Data

US 2015/0292228 A1 Oct. 15, 2015

(30) Foreign Application Priority Data

Oct. 31, 2012 (IT) ..... MO2012A0265

(51) Int. Cl.
*E02D 5/74* (2006.01)
*E04H 12/22* (2006.01)
(Continued)

(52) U.S. Cl.
CPC ..... *E04H 12/2215* (2013.01); *E02D 5/80* (2013.01); *E02D 27/50* (2013.01); *E04H 12/223* (2013.01); *E04H 12/2269* (2013.01)

(58) Field of Classification Search
CPC ..... E04H 12/2215; E04H 12/2269; E04H 12/2223; E04H 12/223; E04H 12/2276
USPC ..... 52/155–159
See application file for complete search history.

(56) References Cited

U.S. PATENT DOCUMENTS 278,220 A * 5/1883 Carson ..... E04F 11/181 256/21
574,191 A * 12/1896 Clayton ..... E04H 12/2215 52/165

(Continued)

FOREIGN PATENT DOCUMENTS

EP 2009182 A2 12/2008
FR 2806747 A1 9/2001

(Continued)

OTHER PUBLICATIONS

International Search Report in PCT/IT2013/000300 dated Mar. 31, 2014.

*Primary Examiner* — Adriana Figueroa
(74) *Attorney, Agent, or Firm* — McGinn IP Law Group, PLLC

(57) ABSTRACT

A system of anchorage of objects in grounds, includes an anchor base provided with tilted guides for rods or pins to be inserted upon assembly; said base being rigidly connected or having a releasable connection with the object or the structure to be anchored to the ground; and said base being provided with tilted guides in minimum number of three; said guides having parallelepiped crossing section in such a way as to house a rod, each guide, presenting a corresponding section and being inserted when assembling the anchorage to the ground; the single rod having hollow section shape, obtained by folding a sheet of rigid material; the hollow section being open at the folding ends of the rod with a minimum distance equal or higher to a fourth of the length of the side of the parallelepiped section on which it is made.

17 Claims, 10 Drawing Sheets

(51) Int. Cl.
*E02D 5/80* (2006.01)
*E02D 27/50* (2006.01)

(56) References Cited

U.S. PATENT DOCUMENTS 979,474 A * 12/1910 Goldsborough ..... E02D 27/42 405/229
2,826,281 A * 3/1958 Johnson ..... E04H 12/223 248/165
3,809,346 A * 5/1974 Jackson ..... E04H 12/223 248/156
5,039,256 A * 8/1991 Gagliano ..... E02D 5/30 405/229
5,104,074 A * 4/1992 Malloy ..... E04H 12/2215 156/63
5,243,795 A * 9/1993 Roberts ..... E02D 27/00 405/244
5,395,184 A * 3/1995 Gagliano ..... E02D 5/00 405/229
5,791,635 A 8/1998 Hull et al.
6,910,832 B2 * 6/2005 Gagliano ..... E02D 27/14 249/34
8,561,361 B2 * 10/2013 Bauletti ..... E04H 12/2215 52/155
2009/0003938 A1 1/2009 Nishimori
2009/0140224 A1 * 6/2009 Ratanasiriwilai ..... E04H 17/12 256/2

FOREIGN PATENT DOCUMENTS

GB 2063327 A * 6/1981 ..... E02D 5/80
GB 2 321 910 A 8/1998

* cited by examiner

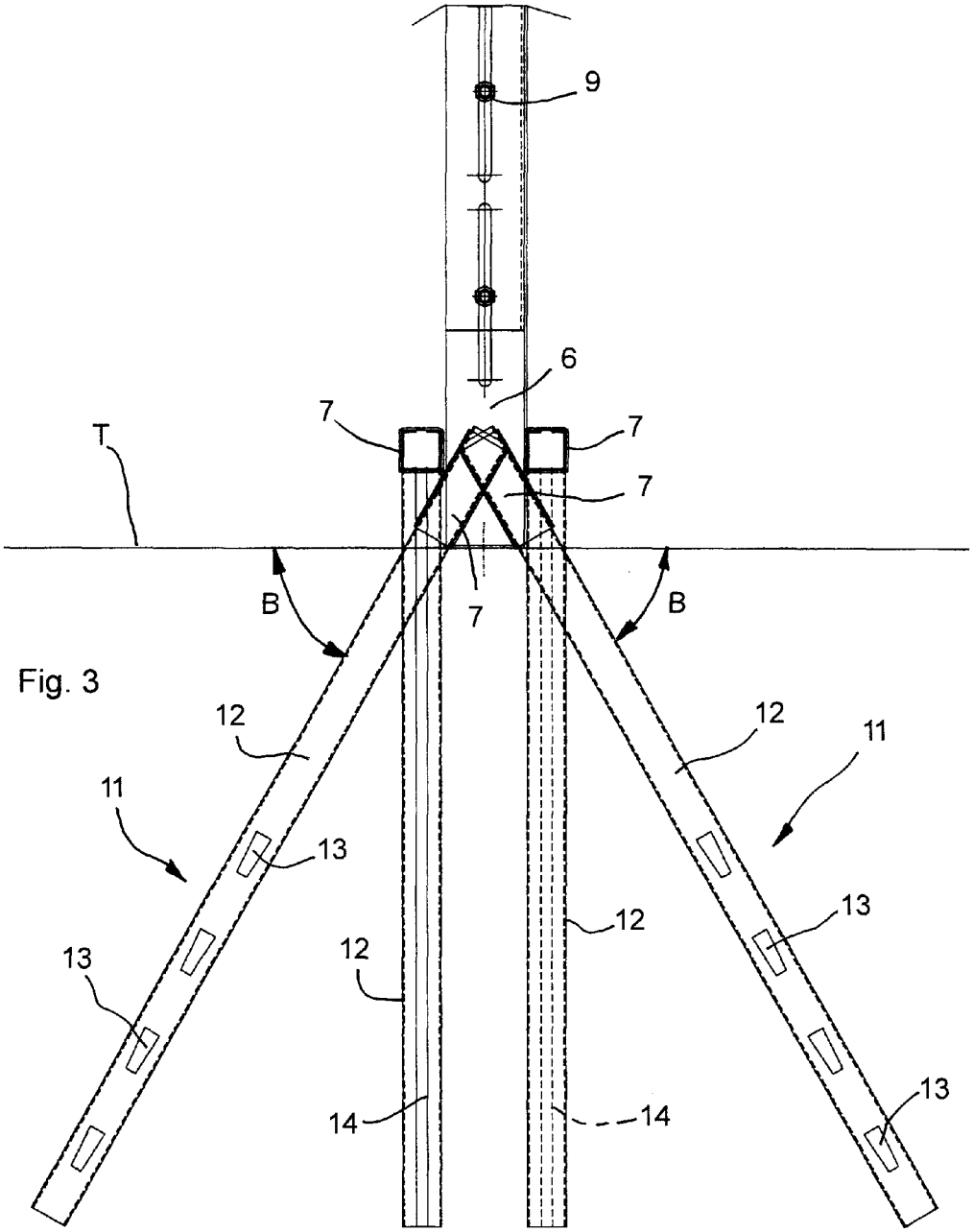
Fig. 3
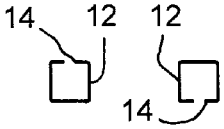
Fig. 4
Fig. 5

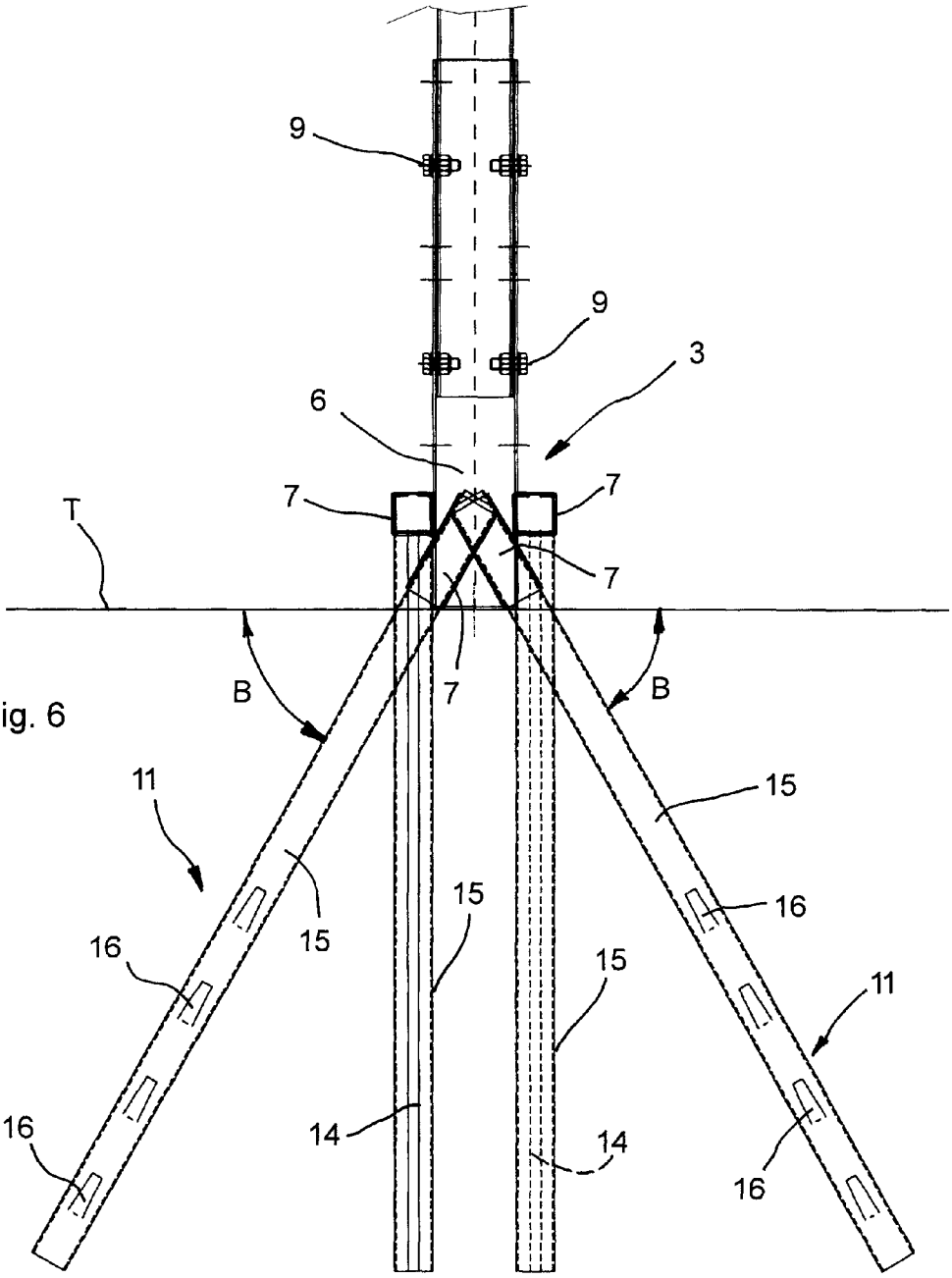
Fig. 6
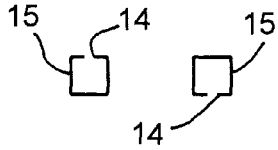
Fig. 4'
Fig. 5'

ANCHORING SYSTEM OF OBJECTS IN THE GROUND

FIELD OF THE INVENTION

This invention relates to an anchorage system of objects in grounds, namely a new way to perform anchorage for any object, e.g. metal piling construction, that would be practical and fast for the installation in different kinds of grounds and soil textures without having to implement any foundations.

KNOWN ART

The background art includes different systems for anchorage, allowing fixing different kind of objects, with also specific solutions for piles in grounds without carrying out preventive foundations.

In the art, as stated above, construction solutions are known, wherein a base of the object is provided with tilted guides to allow the introduction therein of elongated elements such as rods or pins, which entering into the soil and consolidating the position of the base, allow it to act as support of metallic portions or construction or objects in general, to be fixed in the position chosen in a fast and safe way for short period of time or during years after their installation. Said rods or pins have a roundish closed and/or full circular shape or have section-bar shape, etc.

Another anchorage construction method in grounds provides the use of pins or rods obtained from "T" shaped metal section bars within similar guides, thus achieving the anchorage effect, due to the opposite inclination of the bars stuck by the same base into the ground. The "T" section is placed with the wings on the upper part, in order to support the bending forces when entering the rod, and when tearing or eradicating the base, with the central body of the section being tapered at the tip in conjunction with said wings.

A simplified construction for anchorages, with rods or pins for wood piles, is performed by dressing the base of the pole with a sheet folded in such a way to wrap the parallelepiped section pole wherein at least two faces are made by tilted folding adapted to house a rod or pin, each section as an angle section with external vertex. In the assembly, folding acts as tilted guides of the pole base that also has to be stuck into the soil.

By the prior art document U.S. Pat. No. 5,791,635 it is known in the art how to provide the base of the object, generally a post for piling use in fence and the like, with tilted guides of said rods or pins that are welded to the post at a 45 degree angle; moreover, the document also describes the embedment of the post base with the tilted guides and pins attached in those guides to avoid any damages from ill-willed people or vandalism or when upward or tilting forces are applied; also, the text states that multiple tilted guides may be attached to the post, i.e. two or more, at any location of choice and at any angle of choice.

Moreover, according to prior art document FR 2806747, constructive solutions for bases of posts with tilted guides are described as those in the previous document, in which those guides are rigidly connected to a post or box-like object, with a guide inclined on each side, stating that, for soft or weak grounds, as for the amount of rods or pins and consequently guides, but also the sides of the box form, the lack of grip into the ground is overcome by a greater amount of rods or pins applied, i.e. an anchor base with many sides and separate rods, driven into the ground towards many different directions.

As described in the art, methods for the insertion in the ground of anchor rods or pins are performed by section bars having defined sections, which keep their original shape when driven into the ground; i.e. if roundish they resist to deflection stress in all directions also when external forces are exerted to the base to un-anchor it from the ground. With "T" or angular section-bar shapes, a preferred strength direction to deflection is provided and, therefore, tearing of the base from the ground, where it needs to be fixed to, is generally upwardly oriented and does not show resistance to the extraction of the rod or pin individually, so as in case of the post base it also exploits the laying underground action thereof.

Moreover, all these methods to fix the rods or pins into the ground do not oppose the extraction of the same if the force exerted to the base from the outside is axially oriented to the direction of the rod or pin themselves or specifically performed by a user.

For applications requiring quick installation, which these anchorage systems are aimed to, it should be noted that their service life, after their installation, in many cases would be decades, as also service life of the metal objects or structures they support would last decades; so even though they are rapidly installed, in order to keep very low costs, they must be designed to last over time with no subsequent consolidation interventions that would be generating excessive costs.

Therefore, the aforementioned known anchorage systems are not suitable to oppose stress to eradication and/or strain, being it a stress to which the base can be subject to over such a long service life, and they do not ensure a strong seal against the extraction of the composing rods or pins, even if they are mounted with different and appropriate inclination for the kind of ground where they must be fixed into.

This background art may be subject to important improvements with regard to the possibility to achieving an anchorage system of objects in grounds able to overcome the aforementioned drawbacks and providing a stable and long lasting anchorage of the objects connected at the base of anchorage.

Thus, the technical problem related to present invention is to provide an anchorage system of objects in grounds allowing a quick installation of the base and of the objects connected to it, while providing a system capable to really withstand the anchorage against eradicating stress in any direction including extracting the rods or pins embedded in the ground.

An additional and further aim of the present invention is to provide an anchorage suitable to be adapted to all kinds of grounds, which may be used for laying anchorage of objects.

Moreover, another aim of the anchorage, being it provided for metal pilings base, is to be easy and simple to be mounted together with the base of the pole that must fix to the ground with no need to embed the pole itself into the ground.

Moreover, a corollary of previous aims is the specific resistance to the extraction of single rods or pins already present after the assembly and/or consolidating over time.

Finally, a further aspect of the technical problem as mentioned above, is to make the shape of the pin or rod adaptable to the soil according to the response of the soil yet during the insertion upon the assembly of the anchorage.

SUMMARY OF THE INVENTION

This technical problem is solved, according to the present invention by an anchorage system of objects in grounds, comprising an anchor base provided with tilted guides for rods or pins to be inserted during the assembly; said base being rigidly connected or releasable to the object or the structure to be anchored to the ground; characterised in that, said base is provided with a minimum number of three tilted guides; said guides having parallelepiped cross section in such a way as to house a rod, each guide, having a corresponding section and being inserted upon assembly of the anchorage to the ground; the single rod having a hollow section shape, obtained by folding a rigid material sheet; the hollow section being open at the folding end of the rod with equal or higher minimum distance to a fourth of the length of the side of the parallelepiped section on which it is made.

Moreover, in an improved constructive method: on one or more parts of the rod, such as the sides or the edge, there are anchorage means cooperating with the ground in order to increase clamping of the rod.

Moreover, in a specific embodiment: anchorage means are provided with holes or notches at the surface area of the rod section.

Moreover, in an additional embodiment: anchorage means are provided with notched tabs on the sides or on the edge of each rod or as well with rigid clamps already deformed during the production.

Moreover, in a further additional embodiment: the anchorage means are provided with spring clamps provided in the construction of the single rod.

In further and advantageous constructive embodiments: rods have U-shaped parallelepiped section, or C-shaped parallelepiped section, or M-shaped parallelepiped section, all these sections moreover being realized with modular rectangular or square overall dimensions at the crossing section of the tilted guide.

In an improved embodiment: an anchor base being box shaped and having, on at least two side walls, shaped holes to house the crossing section of a rod at two different levels, upper and lower levels, with respect to the vertical position of the base, defining the inclination, with respect to the ground, of the rod inserted into such shaped holes; having, on at least one of the wall surface of the anchor box-shaped base, a tilted guide, with crossing section suitable to house a corresponding tilted rod with similar angle to the one made by the aforementioned shaped holes.

More specifically in an additional embodiment the box-shaped anchor base consists of four sides whose two opposite walls are provided with pairs of upper and lower shaped holes.

Still, on the opposite walls of the anchor base, tilted guides are also placed each of them in the area of the wall with no upper and lower shaped holes.

The rod shape comprising as well: different kinds of anchorage means on the sides or on the edge in order to perform different kinds of anchorage according to the depth when embedding the rod into the ground.

Finally, in a specific and preferred constructive embodiment: the base and the tilted guides are made of metal and single rods are realized by folding metal sheet.

The features and advantages of the present invention, for the embodiment of an anchorage system of objects in grounds, are mentioned in the description given below, with some indicative and non-limiting schematic examples, according to the ten drawing sheets attached.

BRIEF DESCRIPTION OF DRAWINGS

FIG. 3 shows a schematic and enlarged view of a base of the pole of previous Figures leaning on the ground with the rods embedded into the ground connected by means of the only tilted guides of the anchor base;

FIGS. 4, 4' and 5, 5' show the most advantageous embodiments for the introduction of the rods or pins into the guides of the present anchor base which are tilted to the direction of FIG. 3, already described, or FIG. 6 schematically depicting the anchor base of FIG. 3 rotated by a right angle; the depicted C-shaped section is one among the possible sections described in the present invention;

DETAILED DESCRIPTION OF A PREFERRED EMBODIMENT

Figure 2:
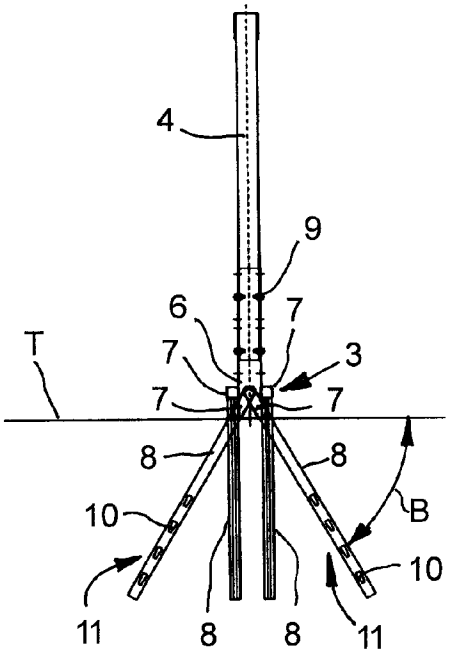
FIG. 2 shows a schematic side-view of a single pole of the structure of FIG. 1 rotated by a right angle.
Figure 1:
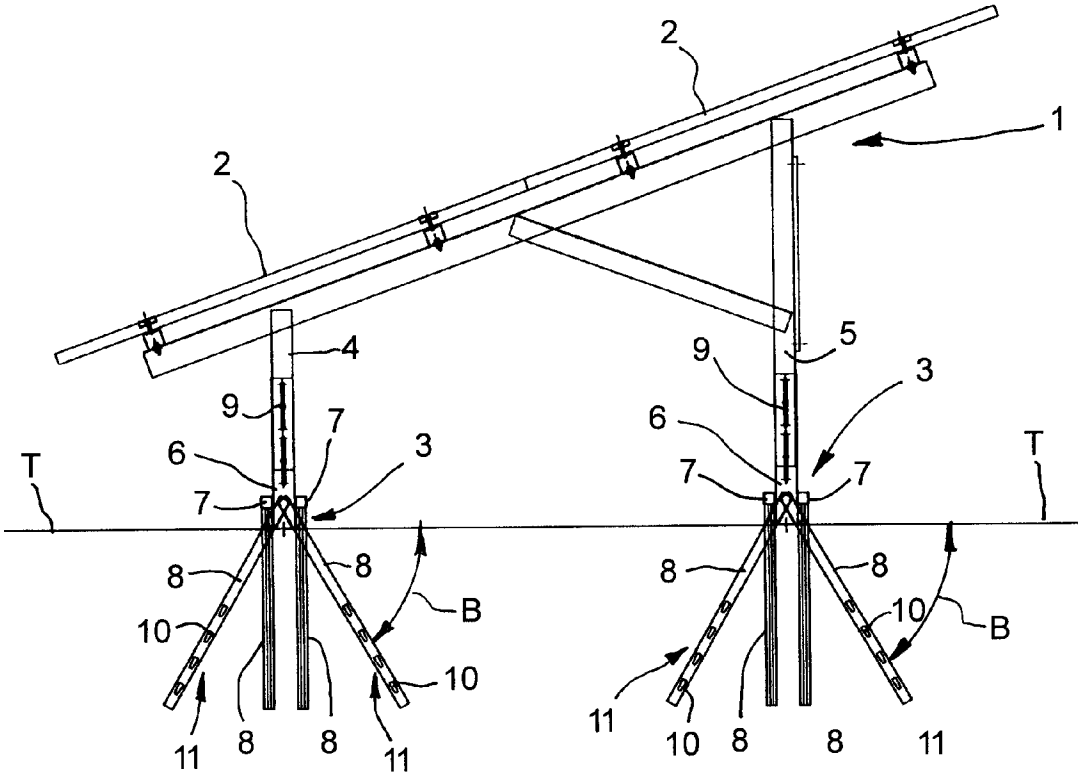
FIG. 1 shows a schematic side-view of a structure anchored to the ground, here for example for the support of photovoltaic panels, adopting the anchorage according to the invention being the shape of the anchorage into the ground marked.

In FIGS. 1 and 2, on a constructive embodiment of a supporting structure 1, e.g. photovoltaic panels 2, the structure needs anchorage 3 to the ground at the base of the poles 4 and 5. The single pole is connected to a corresponding base 6 with a set of at least three tilted guides 7, with crossing section of a parallelepiped rod 8 or pin in thin wall and with open section and rectangular or square outline, that is embedded in the ground T while the tilted guides 7 and the base 6 remain above the ground. In the example shown, the connection between the pole and the corresponding base is performed by a releasable connection 9, but for different objects or structures the connection can be rigid, i.e. the object is rigidly connected to the base also as it is the same part, or for foldable or flexible means, as chains, cables or tie-rods provided for the specific object to be anchored to the base 6. The tilted guides determine the inclination of the rod transfixed in the ground T and said inclination has an incidence angle B, with respect to the ground, within a minimum of 45° to a maximum of 75°.

Each rod in the Figures is provided with means to increase the grip to the ground, in addition to the external and internal surface of the rod 8, comprising further anchorage elements 10 such as notches, holes or tabs, on the sides 11 of the pin or rod 8 which are regular or alternating or pre-ordered in respect to the position of the anchorage element on the rod, in such a way as to prefer a specific position on its sides in the rod more or less transfixed in depth in the soil according to the kind of ground T. The rods or pins transfixed in the ground can be smooth, i.e. with none of the aforementioned anchorage elements, in case of soils with high binder power as clayey grounds or with verified applications ensuring the required clamping.

In FIG. 3, an anchor base 6 is depicted wherein the rods 12 have through-holes 13 in their sides 11; the rod section is C-shaped with ends 14 developed from the section. The four represented rods, in the corresponding tilted guides 6 of the anchor base 3, are placed with said ends being, indifferently, towards the ground or upright the ground, in order to use the most effective deformation effect of the rod section profile upon the introduction into the ground. In FIGS. 4, 4' and 5, 5' opposite C-shaped sections are represented according to the specific inclination of the corresponding tilted guide 7. In FIG. 6, moreover, an anchor base 3 similar to previous FIG. 3 is depicted, wherein the rods 15 have tabs that are only carved 16.

Figure 8:
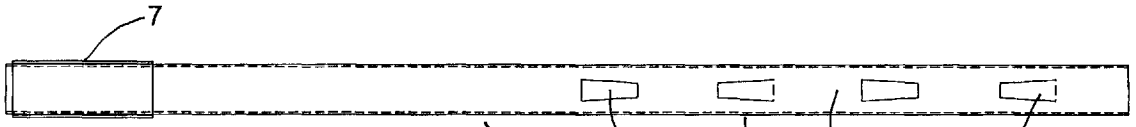
FIGS. 7 and 8 show schematic views of a rod with C-shaped section on two sides, in FIG. 8 together with the coupling guide of the rod at the base of anchorage.
Figure 7:
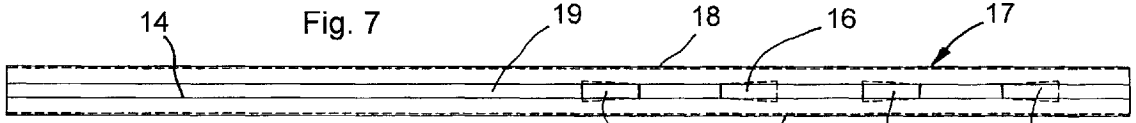
Figure 10:
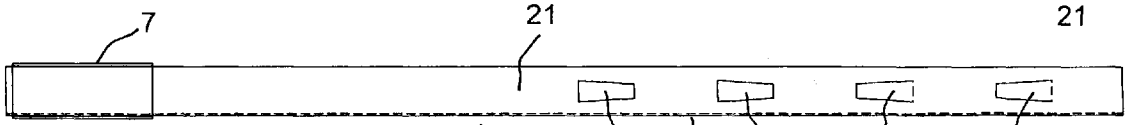
FIGS. 9 and 10 show schematic views of a rod with U-shaped section on two sides, in FIG. 10 together with the coupling guide of the rod at the base of anchorage.
Figure 9:
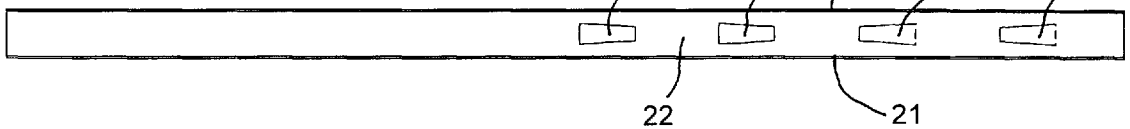

Thus in FIGS. 7 and 8 a rod 17 is shown, here with C-shaped section, on which sides 18 and on edge 19 alternating through-holes 13 or tabs 16 are provided, in such a way as to increase the anchorage of the rod to the ground. Likewise, in FIGS. 9 and 10 a rod 20 is shown, here with U-shaped section, on which sides 21 and on edge 22 through-holes 13 or tabs 16 in side-by-side groups are provided, in such a way as to increase the anchorage of the rod to the ground in a differential way in the depth of the ground.

Figure 11:
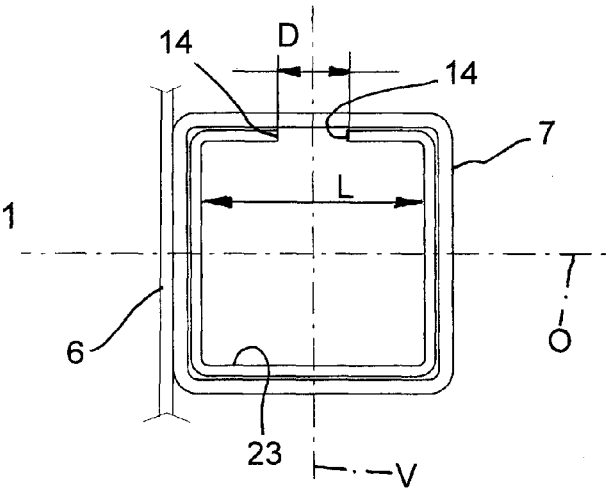
FIG. 11 shows a schematic section of the rod or pin with C-shaped section, according to the invention, within the aforementioned tilted guide in the anchor base; the position of the rod section in the guide can be the one depicted or another one rotated by half turn angle.

FIG. 11 shows a C-shaped rod section within a tilted guide 7, wherein the position of the vertical V plane is always parallel to the side of the anchor base 6, for better functioning of the rod during the anchorage, as explained afterwards. The dashed plane O, which is axial to the rod, is parallel to the rod side with open ends 14 and to the edge 23. In this Figure a square section is depicted, but also rectangular sections could be provided as long as the open ends 14 are placed to a distance D that is not lower to a fourth of the distance L between the adjacent sides in the rod.

Figure 12:
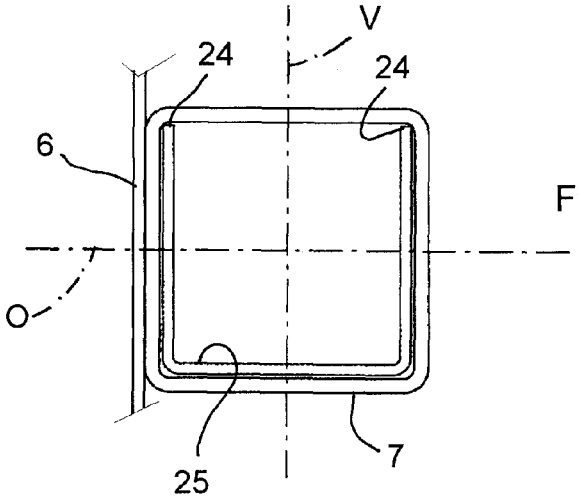
FIG. 12 shows a schematic section of the rod or pin with U-shaped section, according to the invention, within the aforementioned tilted guide in the anchor base; the inserting position being adapted to be similarly rotated as the previous Figure.

FIG. 12 shows a U-shaped rod section within a tilted guide 7, wherein the position of the vertical V plane is always parallel to the side of the anchor base 6, for better functioning of the rod during the anchorage, as explained afterwards. The dashed plane O, which is axial to the rod, is parallel to the open side with the ends 24 and to the edge 25 of the rod. In this Figure a square section is depicted, but also rectangular sections could be provided: here the ends 24 are certainly included in the sizing declared for previous ends 14.

Figure 13:
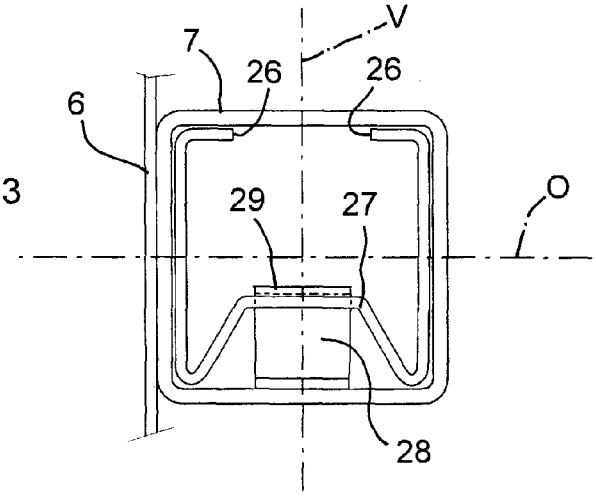
FIG. 13 shows a schematic section of the rod or pin with M-shaped section, according to the invention, within the aforementioned tilted guide in the anchor base wherein a spring clamp on a portion of the wall of the rod is provided, which by the effect of deflection when passing through the tilted guide, remains contained in the pass opening of the guide itself allowing the passage within the guide by eventually emerging from the ground more and more on every extraction attempt.

FIG. 13 shows a M-shaped rod section within a tilted guide 7, wherein the position of the vertical V plane is always parallel to the side of the anchor base 6, for better functioning of the rod during the anchorage, as explained afterwards. The dashed plane O, which is axial to the rod, is parallel to the open side with ends 26 and to the edge 27 of the rod. In this Figure an almost square section is depicted, but also rectangular sections could be provided: also here the ends 26 are included in the sizing as declared for previous ends 14.

Within the section, in order to increase the anchorage on grounds where also gravel seams are present, with grain size distribution within 2 or 3 cm, flexible and spring clamps 28 are provided, here only on the edge 27. The clamp 28, extending preformed from the edge, when passing within the guide 7 re-enters by contacting the internal surface of the guide, loading the flexible part 29. When embedding into the ground, the clamp, being connected by the flexible part to the rod that first enters the ground, is kept closed to the edge 27, but after a light pulling/pushing inversion on the rod, the clamp extends outwards embedding more and more into the ground.

Figure 14:
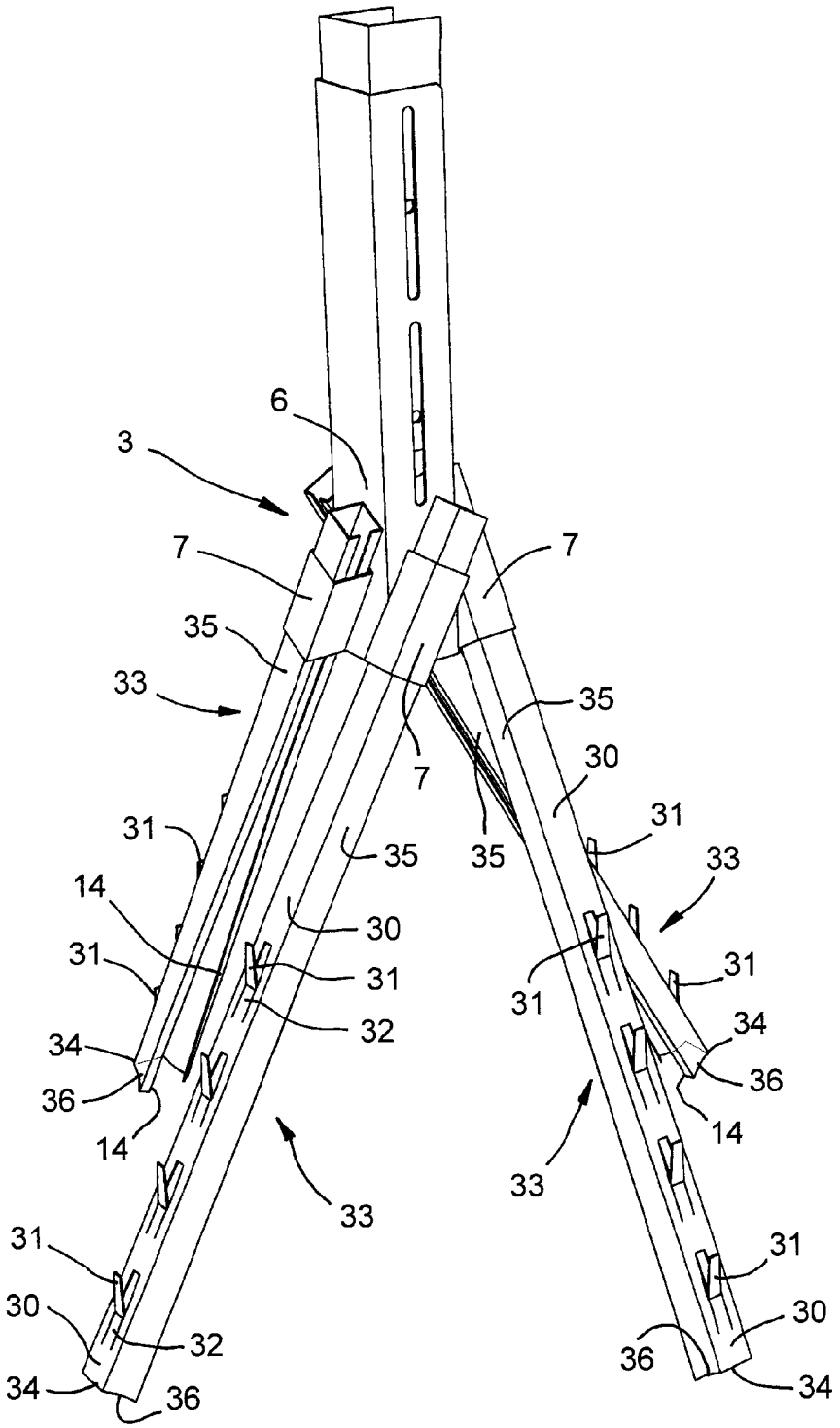
FIG. 14 shows a perspective schematic view of an anchor base for supporting structure's pole, referred herein to examples on previous Figures, in which an insertion effect into the ground of a C-shaped section is depicted, as presented in previous FIGS. 7, 8 and 11; on the back of the rod, spring clamps are depicted, similar to the clamps provided for the rod with M-section of FIG. 13.
Figure 15:
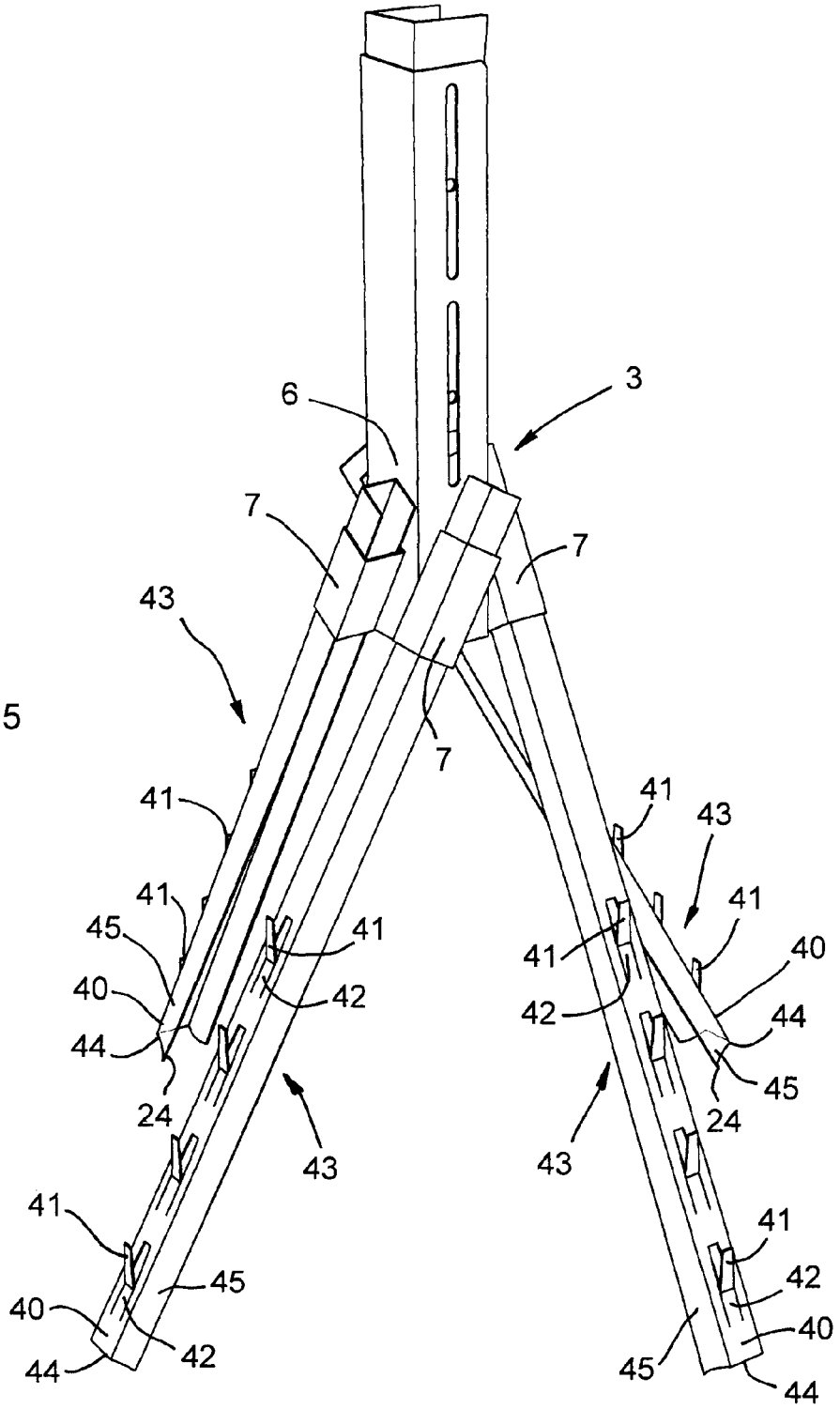
FIG. 15 shows a perspective schematic view of an anchor base for supporting structure's pole, referred herein to examples on previous Figures, in which an insertion effect into the ground of an U-shaped section is depicted, as presented in previous FIGS. 9, 10 and 12; on the back of the rod spring clamps are depicted, similar to the clamps provided for the rod with M-section of FIG. 13.
Figure 16:
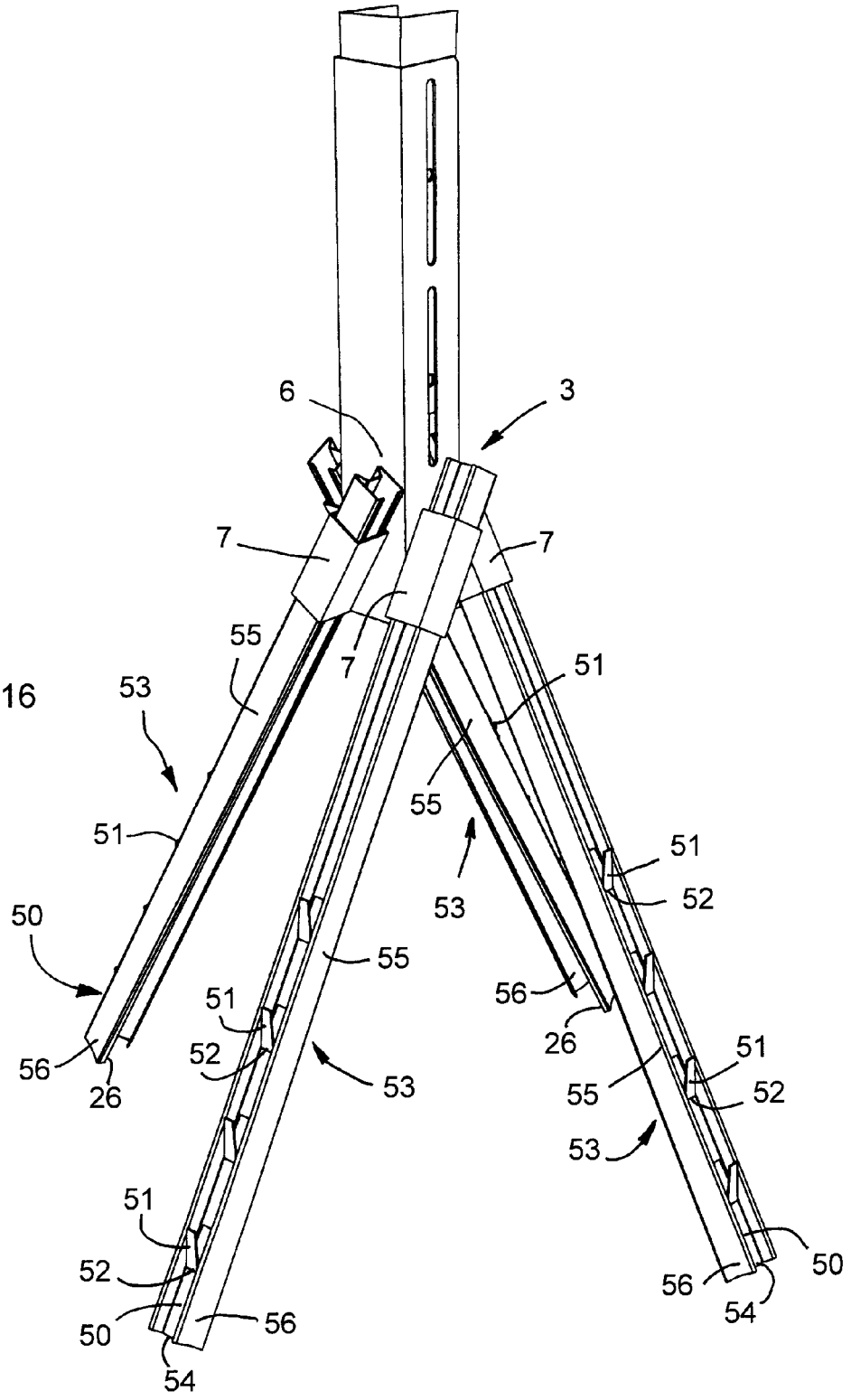
FIG. 16 shows a perspective schematic view of an anchor base for supporting structure's pole, referred herein to examples on previous Figures, in which an insertion effect into the ground of an M-shaped section is depicted, as presented in FIG. 13; on the back of the rod, spring clamps are depicted after their spring-back when the insertion ends and an extraction action of the rod is exerted.

Such behaviour of the rods, when transfixed in the ground, is shown in FIGS. 14-16, wherein rods with different section are transfixed in the ground depicting their strain, favoured by their setting-up, during the insertion and subsequent stress from an extraction attempt on behalf of the user or forces soliciting the anchorage.

In FIG. 14, a C-type rod section is depicted, wherein only on the edge 30 some spring clamps 31 are provided in their connecting lower end 32 to the rod 33. Upon introduction, even if the rods are provided with clamps 31, being already bent outwardly the C-shaped section, said spring clamps will cross down the corresponding guide 7 and will penetrate into the ground, not shown here for simplicity, following the cut made by the front border 34 of the edge 30. When the introduction is completed and the user performs a first extraction attempt, the clamps 31 protrude and stick in the ground thus considerably increasing the anchorage action.

Moreover, as stated above the rods can be manufactured without notches, holes, tabs or clamps, therefore with the only strain of the rod section. In FIG. 14 such strain is shown in the rods 33 depicted, wherein the sides 35 of the rods are bent 36 in proximity of the front edge 34 of the rod: the deflection is on an average proportional to the insertion length of the rod. Deflection causes the extraction to be more difficult, even in the axis of a single rod, due the increase of the projection of the rod section in the ground increasing as well its anchorage action in the ground around the point where it is stuck. Indeed, the greater distance between the depicted ends 14 of the C-shaped section, is possible because the construction distance D is greater than a minimum value and allows the ground to enter inside the section during the insertion, in such a way as to deform the sides and the edge of the section increasing the projection of the section in the ground.

In the aforementioned FIG. 14 spring clamps are depicted, however as described above also simpler anchorage elements can be used, such as simple holes or notches, of any form, or even non-spring tabs, in the sides and in the edge of the rod. While the rod remains in the ground, the natural hydrology of the same tends to occupy said holes or carvings in such a way as to consolidate the position of the rod and therefore of the whole anchorage.

In case of non-spring tabs, being them on the surface, precisely flexing the sides or even the edge, said tabs do not follow the natural deflection of the side or the edge, presenting the free end protruding from the section of the rod. Therefore, upon a following extraction attempt, being it axial, or due to eradication with stress external to the anchorage or by the user, the tabs exit in a similar way as the clamps transfixing the ground and prevent the extraction, i.e. considerably increasing the anchorage ability of the single rod and the overall base, also in grounds with gravel.

In FIG. 15, a U-type rod section is depicted, wherein only on the edge 40 some spring clamps 41 are provided in their connecting lower end 42 to the rod 43. Upon introduction, even if the rods are provided with clamps 41, being already bent outwardly the U-shaped section, said spring clamps will cross down the corresponding guide 7 and will penetrate into the ground, not shown here for simplicity, following the cut made by the front border 44 of the edge 40. When the introduction is completed and the user performs a first extraction attempt, the clamps 41 protrude and stick in the ground thus considerably increasing the anchorage action. Moreover, as stated above the rods show strain of the section of the rod. In FIG. 15 such strain is shown in the rods 43 depicted, wherein the sides 45 of the rods are bent 46 in proximity of the front edge 44 of the rod: the deflection is on an average proportional to the insertion length of the rod.

In FIG. 16, an M-type rod section is represented, wherein only on the edge 50 some spring clamps 51 are provided in their connecting lower end 52 to the rod 53. Upon introduction, even if the rods are provided with clamps 51, being already bent outwardly the M-shaped section, said spring clamps will cross down the corresponding guide 7, both due to the central difference in height of the edge 50 and to a light deflection, and will penetrate into the ground, not shown here for simplicity, following the cut made by the front border 54 of the edge 50. When the introduction is completed and the user performs a first extraction attempt, the clamps 51 protrude and stick in the ground thus considerably increasing the anchorage action. Moreover, as stated above the rods show strain of the section of the rod. In FIG. 15 such strain is shown in the rods 53 depicted, wherein the sides 55 of the rods are bent 56 in proximity of the front edge 54 of the rod: the deflection is on an average proportional to the insertion length of the rod.

Figure 17:
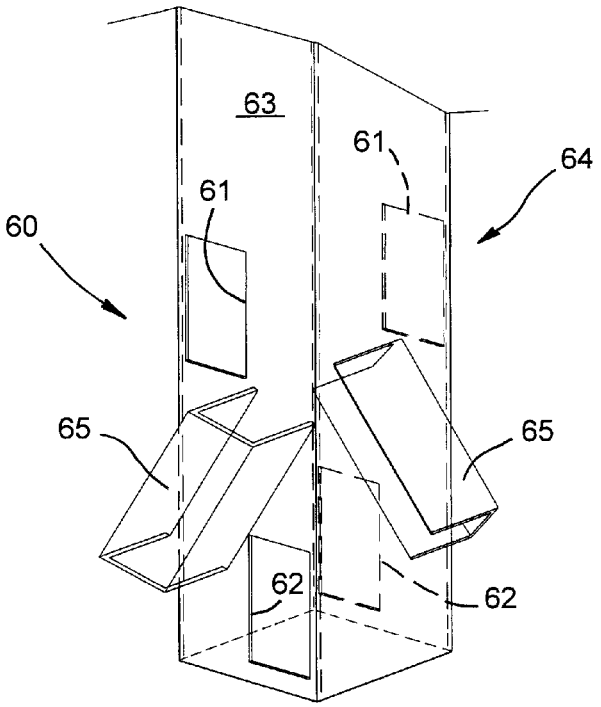
FIG. 17 shows a perspective schematic view of an anchor base for supporting structure's pole, here with box shape of the pole in which holes are provided, said holes being coupled each other and tilted to different height through the length of the pole, to constitute guides for two rods with tilted angular direction opposed to each other, while another pair of guides is applied outside the walls of the box shape.
Figure 18:
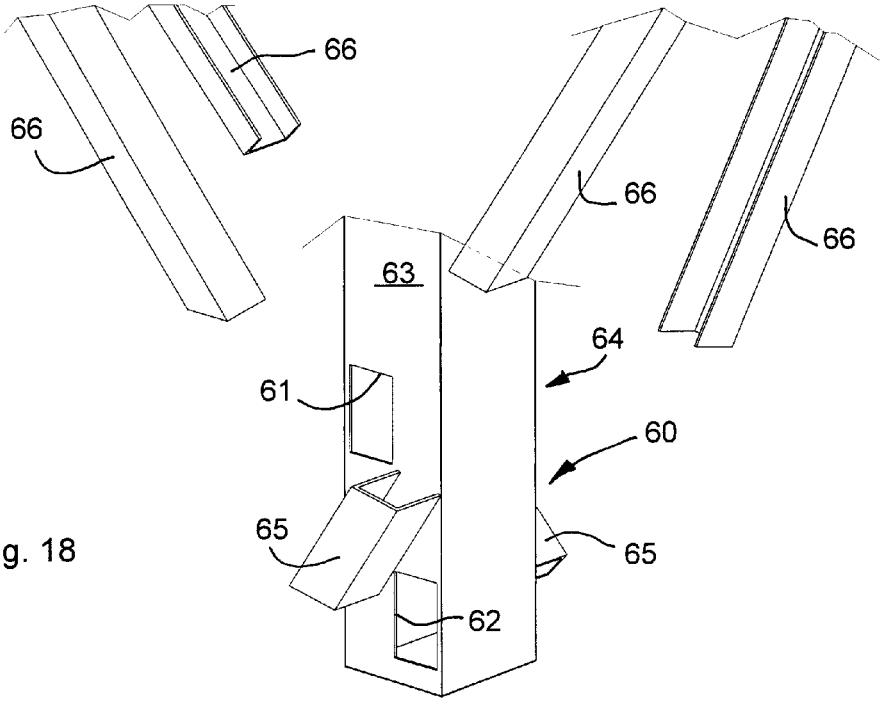
FIG. 18 shows a perspective schematic view of the anchor base of the previous Figure, wherein U-shaped section rods are depicted, with the single initial part being oriented towards the insert direction in said internal guides to the box structure or in the guides externally applied to the sides of said box-shaped structure.
Figure 19:
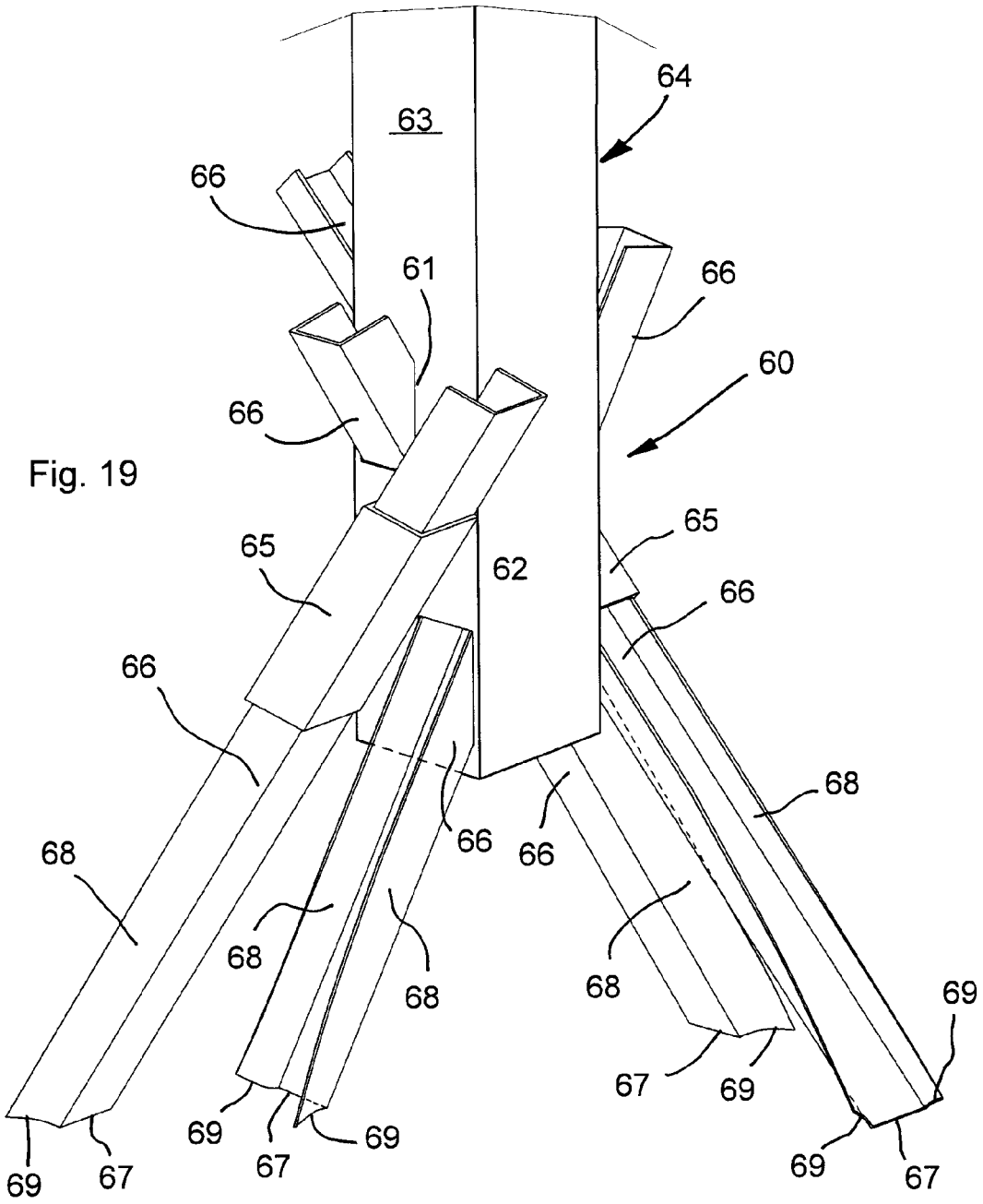
FIG. 19 shows a perspective schematic view of an anchor base of previous FIGS. 17 and 18, wherein the rods, here without clamps, are deformed at the end part initially embedded into the ground, in such a way as to considerably increase the contact between the rods and the ground and strengthening gripping of the rods, so open and deformed, into the ground even if it has weak consistency, it is a moved or wet soil.

In FIGS. 17, 18 and 19 a new anchor base 60 is shaped with box walls, here with four sides, and on two opposite sides, square or rectangular shaped section holes are provided with different height position for the upper shaped holes 61 and the lower shaped holes 62, in such a way as to drive a rod when inserted, i.e. between a wall 63 and the opposite wall 64 of the box anchor base 60. Upper and lower shaped hole pairs are aligned, therefore, to be the guide of a rod introduced herein at an angle B, with respect to the ground, provided in previous Figures; moreover, on the aforementioned walls which are tilted with similar angle B, external guides 65 are applied to the wall, in such a way as to house a pair of rods with inclination on a right-angled vertical plane; the rods 66 being able to have a simple U shape. Said guides are simply and advantageously realized with a U shape connected to the surface of the wall by the end of the sides of the U shape. In FIG. 19, eventually, the rods after being inserted in the ground, not represented here for simplicity, deform at point 67, so that sides 68 show bending 69 due to the deformation that, as described for the other types of rods, increases the gripping of the rod into the ground.

The anchorage functioning according to the invention is performed as follows. The operator places the anchor base 6 in a chosen location. After a preliminary evaluation of the ground, the type of rod is chosen according to its section, its insertion length into the ground, as well as whether it is provided with anchorage elements in order to ensure the desired anchorage capacity.

Then, the operator inserts each rod within the respective guide 7 by completely introducing it into the ground and within the same guide. The anchorage between rod and guide is performed by friction and by contrasting directions between the rods inserted in the ground and the corresponding guides which are differently oriented with respect to the base 6 and are tilted at the angle B with a value ranging from a minimum of 45°, with respect to the ground surface, to a maximum of 75°. In Figures, angle B is shown at 60°.

In this operation the open shape of each rod section, provided by the invention, makes the rod front end to deform little by little while penetrating into the ground, as depicted in FIGS. 14-16. Thus, as for very damp and clayey soils, adhering of the soil to the surface of the rod is already sufficient to ensure a satisfactory anchorage, as shown in FIGS. 17-19 of the box shape anchor base 60 and in the deformation at the points 67 of each rod 66 with the bending 69 of the enlarging sides 68. Further, in FIGS. 17-19 four rods transfixed into the ground are shown, even if only three rods would be sufficient as a result being it a box anchor base with only three sides. Box-shaped anchor bases, as described, can also consist of five or more sides, but this would affect the execution cost and would be advantageous only for big value objects or products to be anchored and certainly should not employed for fast assembly of large amounts of anchorages, such as very extensive fields for photovoltaic panels.

As in hydrological drier or moved grounds, each rod can be realized with means increasing the gripping in the ground, in addition to the external and internal surface of the rod, including anchorage elements such as notches, holes or tabs or even spring or fixed clamps. Each of said anchorage elements is suitable for different kind of soils, e.g. notches are suitable for grounds and aim at its consolidation through the notches thereof, while holes or spring or non-spring clamps are more suitable for not very clayey or sandy soils, or soils having gravel with grain particle size up to 2 or 3 cm, as the rod would also be able to incorporate small stones or end of them, in such a way as to act as a locking rod also in clayey types of grounds with poor or totally lack of tackiness. Finally, tabs extending by deformation have similar behaviour as clamps, but said tabs are suitable in compact grounds, wherein also slight extensions can generate significant anchorage effects.

The advantages in the embodiment and use of an anchorage according to the invention can be summarized as the most complete adaptability of the anchor base thereof to the anchorage capacity that each different kind of soil allows. In fact, the base 6 being provided with a minimum number of tilted guides 7, i.e. three in order to direct the rods in the ground as to make each rod locking any possible movements of the other one, can also be provided with a greater number of tilted guides and therefore of rods transfixed in the ground. Examples of Figures show four tilted guides 7 and therefore four rods, which are oriented in tilted, pair directions to reciprocal opposition and right-angled between two adjacent ones. The incidence angle B, with respect to the surface of the anchorage ground, should not be significantly too low to avoid yielding upon strain of the anchorage of the overhanging soil as not too high to avoid low resistance to the vertical extraction of the anchorage, occurring when more anchorages work in combination between each other and the structure that joins has strain and stress actions on them.

A further and important advantage is having a single anchor base and being able to vary the gripping and clinging capacity to the ground of the single rod for its specific constitution, according to the soil typology to be penetrated by the rod. Obviously when installing structures, expected to be in place for decades, such insertion in the ground cannot be performed without an initial and appropriate study and survey of the penetration capacity into the ground and of the gripping of the anchorage. With the various described rod shapes, i.e. with different section forms, with different arrangement of anchorage elements on the sides and edge of the single rod, as well as with the considerable different anchorage action on the rod, the described elements: holes, notches, tabs and clamps both rigid and spring, can calibrate the anchorage capacity of the rod to be used specifically to a soil, according to the needs and requirements of the installer.

In brief, the most evident advantages are the speed in assembling and at the same time the security of the expected outcome, being certain the different gripping capacity of the rods in the specific grounds in which they have been tested, having given satisfactory and enduring results, in such a way as to decrease the introduction time into the soil, being the inventive rods possibly shorter than other rods known in the at, because of their greater capacity of gripping into the ground.

Obviously, those skilled in the art could make several changes to the anchorage system of objects in grounds described above, in order to meet specific needs and requirements, all falling within the scope of protection of the present invention as defined by the following claims.

The invention claimed is:

1. A system of anchorage of objects in grounds, comprising:

an anchor base provided with tilted guides for rods or pins to be inserted during the assembly, wherein said anchor base is rigidly connected or has a releasable connection with the object or the structure to be anchored to the ground, wherein said anchor base includes at least three tilted guides having a parallelepiped cross section in such a way as to house the rod, each guide, having a corresponding section and being inserted upon the assembly of the anchorage to the ground, wherein at least one of the rods comprises a hollow section, obtained by folding a sheet of rigid material, wherein the hollow section is open between folding ends of the rod with a minimum distance being equal to or greater than a fourth of a distance between opposite sides of the hollow section, and wherein the open hollow section, when introduced into soil, allows a deformation effect, bending a front edge and enlarging sides of the rod, to increase gripping and adhering of the soil into the open hollow section.

2. An anchorage system, according to claim 1, wherein at least one of a side of the rod edge of the rod, are provided with elements of anchorage to cooperate with the soil and increase the clamping of the rod.

3. An anchorage system, according to claim 2, wherein the anchorage elements consist of holes or notches in the surface of the section of the rod.

4. An anchorage system, according to claim 2, wherein the anchorage elements comprise notched tabs on the side or on the edge of the single rod or of rigid clamps already deformed when manufactured.

5. An anchorage system, according to claim 2, wherein the anchorage elements consist of spring clamps provided when the single rod is manufactured.

6. An anchorage system, according to claim 1, wherein the rods have a U-shaped parallelepiped section, with square or rectangular size.

7. An anchorage system, according to claim 1, wherein the rods have a C-shaped parallelepiped section, with square or rectangular size.

8. An anchorage system, according to claim 1, wherein the rods have a M-shaped parallelepiped section, with square or rectangular size.

9. An anchorage system, according to claim 2, wherein the rods have different kinds of anchorage elements on the sides or on the edge as to achieve different anchorage capacity according to the insertion depth of the rod in the ground.

10. An anchorage system, according to claim 1, wherein the anchor base has a box shape and on at least two opposed walls has holes shaped as to house the cross section of the rod at two different levels, upper and lower, with respect to the vertical position of the base, defining the inclination, with respect to the ground, of the rod introduced in the shaped holes; on the wall surface of the anchor base of the opposed walls, a tilted guide is provided, having a cross section suitable to house a corresponding tilted rod at a similar angle as the one provided for the aforementioned shaped holes.

11. An anchorage system, according to claim 10, wherein the box-shaped anchor base has four sides and wherein on two opposed walls, of said four sides, pairs of the lower shaped holes and the upper shaped holes are provided.

12. An anchorage system, according to claim 11, wherein on opposite walls, in the wall area free from the upper and lower shaped holes, a tilted guide is provided.

13. An anchorage system, according to claim 1, wherein the angle of inclination of the rods, with respect to the ground is within 45° and 75°.

14. An anchorage system, according to claim 10, wherein the tilted guides have a U shape connected to the surface of the wall by the ends of the sides of the U, thereof.

15. An anchorage system, according to claim 1, wherein the base and the tilted guides comprise metal, and the rods comprise a folded metal sheet.

16. A system for anchoring an object, comprising:

a pole which is connectable to the object;

an anchor base comprising a first opening, the pole being inserted into the first opening;

a plurality of tilted guides having a parallelepiped cross section connected to the anchor base and including a plurality of second openings, respectively; and a plurality of rods which are inserted into the plurality of second openings, respectively, the plurality of rods comprising a folded sheet of rigid material having an open hollow section formed on a side of the folded sheet and between opposing ends of the folded sheet, and a distance between the opposing ends of the folded sheet being equal to or greater than 25% of the length of the side of the folded sheet, wherein a front edge and sides of the rod, to increase gripping and adhering of a soil into the open hollow section, are deformed and bent when introduced into the soil.

17. The system of claim 16, wherein the object comprises a photovoltaic panel.

* * * * *